US011480369B2

(12) United States Patent
Zhang et al.

(10) Patent No.: US 11,480,369 B2
(45) Date of Patent: Oct. 25, 2022

(54) FRESH-AIR AIR CONDITIONING SYSTEM AND CONTROL METHOD

(71) Applicant: SHANGHAI HIGHLY ELECTRICAL APPLIANCES CO., LTD., Shanghai (CN)

(72) Inventors: Lei Zhang, Shanghai (CN); Chunhui Liu, Shanghai (CN)

(73) Assignee: SHANGHAI HIGHLY ELECTRICAL APPLIANCES CO., LTD., Shanghai (CN)

( * ) Notice: Subject to any disclaimer, the term of this patent is extended or adjusted under 35 U.S.C. 154(b) by 764 days.

(21) Appl. No.: 16/479,603

(22) PCT Filed: Dec. 28, 2017

(86) PCT No.: PCT/CN2017/119350
§ 371 (c)(1),
(2) Date: Jul. 22, 2019

(87) PCT Pub. No.: WO2019/061914
PCT Pub. Date: Apr. 4, 2019

(65) Prior Publication Data

US 2021/0333027 A1 Oct. 28, 2021

(30) Foreign Application Priority Data

Sep. 29, 2017 (CN) ..... 201710912028.6

(51) Int. Cl.
*F25B 5/00* (2006.01)
*F25B 31/00* (2006.01)
*F25B 41/20* (2021.01)
*F25B 39/02* (2006.01)

(52) U.S. Cl.
CPC ..... *F25B 31/004* (2013.01); *F25B 39/02* (2013.01); *F25B 41/20* (2021.01)

(58) Field of Classification Search
CPC ..... F25B 31/004; F25B 41/20; F25B 39/02; F25B 43/006; F25B 2313/001;
(Continued)

(56) References Cited

U.S. PATENT DOCUMENTS 5,878,810 A 3/1999 Saito et al.
10,451,324 B2 * 10/2019 Kawagoe ..... F25B 1/00

FOREIGN PATENT DOCUMENTS

CN 103851840 6/2014
CN 204312328 5/2015
(Continued)

OTHER PUBLICATIONS

"International Search Report (Form PCT/ISA/210) of PCT/CN2017/119350," dated May 7, 2018, with English translation thereof, pp. 1-6.

*Primary Examiner* — Henry T Crenshaw
*Assistant Examiner* — Kamran Tavakoldavani
(74) *Attorney, Agent, or Firm* — JCIP Global Inc.

(57) ABSTRACT

A fresh-air air conditioning system comprises: a first electromagnetic valve connected to a first interior heat exchanger, and the first electromagnetic valve is connected via a first accumulator to a compressor and a third electromagnetic valve; the third electromagnetic valve is connected via a second accumulator to the compressor and a second electromagnetic valve; and the second electromagnetic valve is connected to a second interior heat exchanger. When the first interior heat exchanger or the second interior heat exchanger is closed, the third electromagnetic valve opens so that the first accumulator and the second accumulator simultaneously communicate with the open one of the first interior heat exchanger or the second interior heat exchanger, avoiding poor oil return as a result of prolonged
(Continued)

single-cylinder operation of the compressor, and ensuring the reliability of the compressor as well as interior comfort.

14 Claims, 1 Drawing Sheet

(58) Field of Classification Search
CPC ..... F25B 2213/0233; F25B 2400/0401; F25B 2400/06; F25B 2500/16; F25B 2600/2501
USPC ..... 62/117
See application file for complete search history.

(56) References Cited

FOREIGN PATENT DOCUMENTS

| | | |
|---|---|---|
| CN | 104676796 | 6/2015 |
| CN | 105115181 | 12/2015 |
| CN | 105890081 | 8/2016 |
| CN | 205641699 | 10/2016 |
| CN | 205860208 | 1/2017 |
| CN | 205980121 | 2/2017 |
| CN | 206094634 | 4/2017 |
| CN | 106642306 | 5/2017 |
| CN | 106766327 | 5/2017 |
| CN | 206160545 | 5/2017 |
| CN | 206281236 | 6/2017 |
| CN | 206281239 | 6/2017 |
| CN | 107084496 | 8/2017 |
| EP | 1890093 | 2/2008 |
| JP | H03124170 | 5/1991 |
| JP | 3873288 | 1/2007 |
| JP | 2010255859 | 11/2010 |
| JP | 2013124792 | 6/2013 |
| JP | 2013253714 | 12/2013 |

* cited by examiner

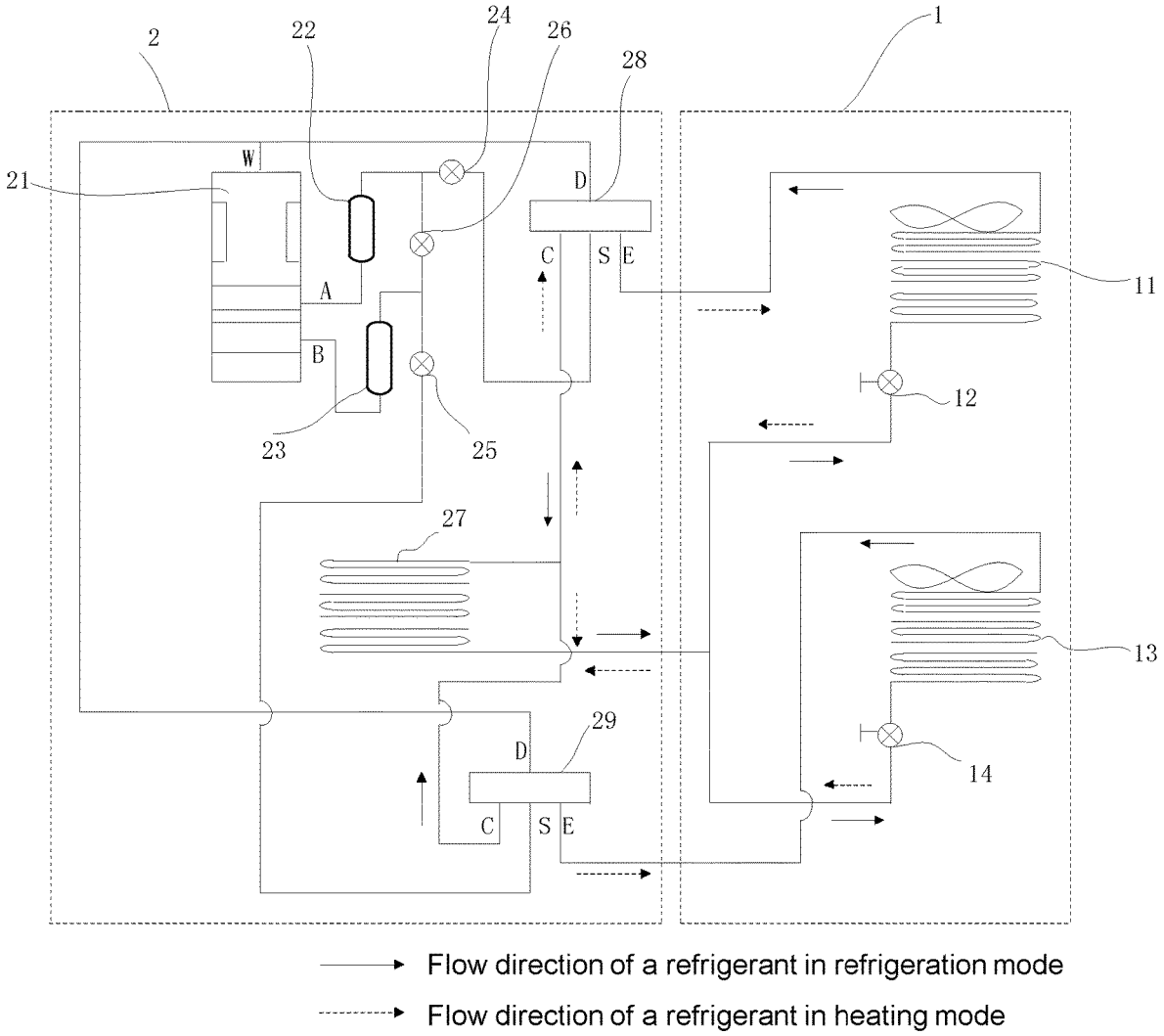
2
22
24
26
28
1
21
W
D
C
S
E
A
B
11
12
23
25
27
13
29
D
C
S
E
14
Flow direction of a refrigerant in refrigeration mode
Flow direction of a refrigerant in heating mode

FRESH-AIR AIR CONDITIONING SYSTEM AND CONTROL METHOD

CROSS-REFERENCE TO RELATED APPLICATION

This application is a 371 of international application of PCT application serial no. PCT/CN2017/119350, filed on Dec. 28, 2017, which claims the priority benefit of China application no. 201710912028.6, filed on Sep. 29, 2017. The entirety of each of the above mentioned patent applications is hereby incorporated by reference herein and made a part of this specification.

TECHNICAL FIELD

The present invention relates to the field of air conditioning system, and in particular, to a fresh-air air conditioning system and control method.

BACKGROUND

As the double evaporation temperature compressor is applied to various air conditioning systems such as the system using one outdoor unit to drive operation of two indoor units, a fresh-air air conditioning system, and the like, the situation that one of the evaporators in the air conditioning system needs to be turned off when the system is under partial load is occurred, which results in the following problems for the system and the compressor:

1. A corresponding intake pipeline of the compressor needs to be turned off if one of the evaporators is turned off. Long-term single-cylinder operation of the double-evaporator temperature compressor may cause accumulation of refrigeration oil into the liquid accumulator of the turned-off intake pipeline, resulting in poor oil return of the compressor.

2. The situation occurred in the above point 1 can be avoided by means of the oil return operation of the system. Usually, the system needs to perform the oil return operation via simultaneously running the two cylinders at an interval of about once every 2 hours. However, frequent oil return operations affect the indoor comfort to a certain degree.

SUMMARY OF THE INVENTION

It is an object of the present invention to provide a fresh-air air conditioning system and a control method to solve the problems in the prior art that the long-term single cylinder operation of the compressor results in the poor oil return of the compressor as the air conditioning system is under partial load and the frequent oil return operations performed by the system affect the indoor comfort to a certain degree.

To achieve the foregoing object, the present invention provides a fresh-air air conditioning system comprising an indoor unit and an outdoor unit, wherein the indoor unit includes a first indoor heat exchanger and a second indoor heat exchanger; and the outdoor unit includes a compressor, an intake bypass circuit, a first liquid accumulator, and a second liquid accumulator; wherein the intake bypass circuit includes a first electromagnetic valve, a second electromagnetic valve and a third electromagnetic valve, a first end of the first electromagnetic valve being connected to a first end of the first indoor heat exchanger, a second end of the first electromagnetic valve being connected to a first intake end of the compressor and a first end of the third electromagnetic valve via the first liquid accumulator, a second end of the third electromagnetic valve being connected to a second intake end of the compressor and a first end of the second electromagnetic valve via the second liquid accumulator, a second end of the second electromagnetic valve being connected to a first end of the second indoor heat exchanger; and wherein when the first indoor heat exchanger or the second indoor heat exchanger is turned off, the third electromagnetic valve is opened so that the first liquid accumulator and the second liquid accumulator are simultaneously communicated with an opened one of the first indoor heat exchanger and the second indoor heat exchanger.

Optionally, the outdoor unit further includes an outdoor heat exchanger, a first four-way valve and a second four-way valve, the first end of the first indoor heat exchanger being connected to a first port E of the first four-way valve, a second port S of the first four-way valve being connected to the first end of the first electromagnetic valve, a second end of the first indoor heat exchanger being connected to a first end of the outdoor heat exchanger, a second end of the outdoor heat exchanger being connected to a third port C of the first four-way valve and a third port C of the second four-way valve, a fourth port D of the first four-way valve being connected to an exhaust end of the compressor, the first end of the second indoor heat exchanger being connected to a first port E of the second four-way valve, a second port S of the second four-way valve being connected to the second end of the second electromagnetic valve, a second end of the second indoor heat exchanger being connected to the first end of the outdoor heat exchanger, a fourth port D of the second four-way valve being connected to the exhaust end of the compressor.

Optionally, the indoor unit further comprises a first throttle mechanism and a second throttle mechanism; wherein the first throttle mechanism throttles and reduces the pressure of the refrigerant passing through the first indoor heat exchanger pressure, and the second throttle mechanism throttles and reduces the pressure of the refrigerant passing through the second indoor heat exchanger.

Optionally, the first throttle mechanism is an electronic expansion valve and the second throttle mechanism is an electronic expansion valve.

The present invention also provides a control method of a fresh-air air conditioning system, including: opening a third electromagnetic valve when one of the first indoor heat exchanger and the second indoor heat exchanger is turned off so that a first liquid accumulator and a second liquid accumulator are simultaneously communicated with an opened one of the first indoor heat exchanger and the second indoor heat exchanger.

Optionally, the control method of the fresh-air air conditioning system further includes: closing a second electromagnetic valve and opening a first electromagnetic valve when the first indoor heat exchanger is set to be turned on and the second indoor heat exchanger is set to be turned off.

Optionally, in the control method of the fresh-air air conditioning system, an outdoor unit includes an outdoor heat exchanger and a first four-way valve; when the fresh-air air conditioning system is in a refrigeration mode, a refrigerant driven by a compressor enters into a fourth port D of the first four-way valve via an exhaust end of the compressor and enters into the outdoor heat exchanger via a third port C of the first four-way valve to release heat before entering into the first indoor heat exchanger for refrigeration, and then enters into the first liquid accumulator and the second liquid accumulator via a first port E and a second port S of the first four-way valve.

Optionally, in the control method of the fresh-air air conditioning system, an outdoor unit includes an outdoor heat exchanger and a first four-way valve; when the fresh-air air conditioning system is in a heating mode, a refrigerant driven by a compressor enters into a fourth port D of the first four-way valve via an exhaust end of the compressor and enters into the first indoor heat exchanger via a first port E of the first four-way valve to release heat before entering into the outdoor heat exchanger for heat absorption, and then enters into the first liquid accumulator and the second liquid accumulator via a third port C and a second port S of the first four-way valve.

Optionally, the control method of the fresh-air air conditioning system further includes: closing a first electromagnetic valve and opening a second electromagnetic valve when the first indoor heat exchanger is set to be turned off and the second indoor heat exchanger is set to be turned on.

Optionally, in the control method of the fresh-air air conditioning system, an outdoor unit includes an outdoor heat exchanger and a second four-way valve; when the fresh-air air conditioning system is in a refrigeration mode, a refrigerant driven by a compressor enters into a fourth port D of the second four-way valve via an exhaust end of the compressor and enters into the outdoor heat exchanger via a third port C of the second four-way valve to release heat before entering into the second indoor heat exchanger for refrigeration, and then enters into the first liquid accumulator and the second liquid accumulator via a first port E and a second port S of the second four-way valve.

Optionally, in the control method of the fresh-air air conditioning system, an outdoor unit comprises an outdoor heat exchanger and a second four-way valve; when the fresh-air air conditioning system is in a heating mode, a refrigerant driven by a compressor enters into a fourth port D of the second four-way valve via an exhaust end of the compressor and enters into the first indoor heat exchanger via a first port E of the second four-way valve to release heat before entering into the outdoor heat exchanger for heat absorption, and then enters into the first liquid accumulator and the second liquid accumulator via a third port C and a second port S of the second four-way valve.

In the fresh-air air conditioning system and the control method provided in the present invention, the fresh-air air conditioning system includes an indoor unit and an outdoor unit, the indoor unit including a first indoor heat exchanger and a second indoor heat exchanger, the outdoor unit including a compressor, an intake bypass circuit, a first liquid accumulator, and a second liquid accumulator. When the first indoor heat exchanger or the second indoor heat exchanger is turned off, the intake bypass circuit enables the first liquid accumulator and the second liquid accumulator to be simultaneously communicated with the opened one of the first indoor heat exchanger and the second indoor heat exchanger, thereby avoiding the situation of poor oil return caused by the long-term single cylinder operation of the compressor, ensuring the reliability of the compressor, improving the performance of the fresh-air air conditioning system and the indoor comfort, and bringing a better user experience.

BRIEF DESCRIPTION OF THE DRAWINGS

FIG. 1 is a schematic structural diagram of a fresh-air air conditioning system according to an embodiment of the present invention, in which:

1—Indoor unit; 11—First indoor heat exchanger; 12—First throttle mechanism; 13—Second indoor heat exchanger; 14—Second throttle mechanism; 2—Outdoor unit; 21—Compressor; 22—First liquid accumulator; 23—Second liquid accumulator; 24—First electromagnetic valve; 25—Second electromagnetic valve; 26—Third electromagnetic valve; 27—Outdoor heat exchanger; 28—First four-way valve; 29—Second four-way valve.

DETAILED DESCRIPTION

Specific embodiments of the present invention will be described in detail below with reference to the accompanying drawings. Advantages and features of the present invention will be more apparent from the description and appended claims. It should be noted that the accompanying drawings are provided in a very simplified form and not necessarily presented to scale, with the only intention to facilitate convenience and clarity in explaining the embodiments.

FIG. 1 is a schematic structural diagram of a fresh-air air conditioning system provided by this embodiment. As shown in FIG. 1, the fresh-air air conditioning system includes an indoor unit 1 and an outdoor unit 2. The indoor unit 1 includes a first indoor heat exchanger 11 and a second indoor heat exchanger 13. The outdoor unit 2 includes a compressor 21 and an intake bypass circuit. When the first indoor heat exchanger 11 or the second indoor heat exchanger 13 is turned off, the intake bypass circuit achieves simultaneously run of two cylinders (each cylinder corresponds to an intake pipeline and an intake end) of the compressor 21, thereby avoiding the situation of the poor oil return of the compressor, which is caused by the accumulation of refrigeration oil due to the long term single cylinder operation of compressor in the case that the corresponding intake pipeline of the compressor is needed to be turned off along with the turnoff of one of the indoor heat exchangers. Therefore, the reliability of the compressor is guaranteed, the system performance is enhanced and the indoor comfort is ensured.

A control method of the fresh-air air conditioning system is further provided. The fresh-air air conditioning includes an indoor unit 1 and an outdoor unit 2. The indoor unit 1 includes a first indoor heat exchanger 11 and a second indoor heat exchanger 13. The outdoor unit 2 includes a compressor 21 and an intake bypass circuit. The method includes: enabling, by the intake bypass circuit, two cylinders of the compressor 21 to simultaneously run when the first indoor heat exchanger 11 or the second indoor heat exchanger 13 is turned off.

The intake bypass circuit includes a first electromagnetic valve 24, a third electromagnetic valve 26, and a second electromagnetic valve 25 which are successively connected. A first end of the first electromagnetic valve 24 is connected to a first end of the first indoor heat exchanger 11, and a second end of the first electromagnetic valve is connected to an inspiration end A of the compressor 21 and a first end of the third electromagnetic valve 26. A second end of the third electromagnetic valve 26 is connected to an intake end B of the compressor 21 and a first end of the second electromagnetic valve 25. A second end of the second electromagnetic valve 25 is connected to a first end of the second indoor heat exchanger 13.

The outdoor unit 2 further includes a first liquid accumulator 22 and a second liquid accumulator 23. The intake end A of the compressor 21 is connected to the second end of the first electromagnetic valve 24 and the first end of the third electromagnetic valve 26 via the first liquid accumulator 22. The intake end B of the compressor 21 is connected to the second end of the third electromagnetic valve 26 and the first end of the second electromagnetic valve 25 via the second liquid accumulator 23.

The first end of the first indoor heat exchanger 11 is connected to a first port E of a first four-way valve 28, a second port S of the first four-way valve 28 is connected to the first end of the first electromagnetic valve 24, and a second end of the first indoor heat exchanger 11 is connected to a first end of the outdoor heat exchanger 27. A second end of the outdoor heat exchanger 27 is connected to a third port C of the first four-way valve 28 and a third port C of a second four-way valve 29, and a fourth port D of the first four-way valve 28 is connected to an exhaust end W of the compressor 21. The first end of the second indoor heat exchanger 13 is connected to a first port E of the second four-way valve 29, and a second port S of the second four-way valve 29 is connected to the second end of the second electromagnetic valve 25. A second end of the second indoor heat exchanger 13 is connected to the first end of the outdoor heat exchanger 27, and a fourth port D of the second four-way valve 29 is connected to the exhaust end W of the compressor 21.

When only one indoor heat exchanger of the fresh-air air conditioning system is turned on (that is, the fresh-air air conditioning system is under partial load), the switching mode of the intake bypass circuit of the compressor is shown in the following table:

| | | First indoor heat exchanger | Second indoor heat exchanger | First electro-magnetic valve | Second electro-magnetic valve | Third electro-magnetic valve |
|---|---|---|---|---|---|---|
| Refrigeration mode | Full load | ON | ON | ON | ON | OFF |
| | Partial load | ON | OFF | ON | OFF | ON |
| | | OFF | ON | OFF | ON | ON |
| Heating mode | Full heating mode | ON | ON | ON | ON | OFF |
| | Partial heating mode | ON | OFF | ON | OFF | ON |
| | | OFF | ON | OFF | ON | ON |

If each of the first indoor heat exchanger 11 and the second indoor heat exchanger 13 is set to be turned on (that is, the fresh-air air conditioning system is under full load), then the first electromagnetic valve 24 and the second electromagnetic valve 25 are in an opened state, and the third electromagnetic valve 26 is closed.

In this case, the outdoor unit 2 includes the outdoor heat exchanger 27, the first four-way valve 28, the second four-way valve 29, the first liquid accumulator 22 and the second liquid accumulator 23, and the indoor unit 1 includes a first throttle mechanism 12 and a second throttle mechanism 14.

When the fresh-air air conditioning system is in a refrigeration mode, the gaseous refrigerant having a low temperature and pressure is transformed into the gaseous refrigerant having a high temperature and pressure after being sucked and pressurized by the compressor 21, and then enters into the fourth port D of the first four-way valve 28 and the fourth port D of the second four-way valve 29 via the exhaust end W of the compressor 21 before entering into the outdoor heat exchanger via the third port C of the first four-way valve 28 and the third port C of the second four-way valve 29. The gaseous refrigerant having a high temperature and pressure releases heat (through condensation of a condenser) in the outdoor heat exchanger 27, and turns into the liquid refrigerant having a medium temperature and a high pressure (the heat is taken away by outdoor circulating air). The liquid refrigerant having a medium temperature and a high pressure is throttled and depressurized by passing through the first throttle mechanism 12 and the second throttle mechanism 14, and then turns into the liquid refrigerant having a low temperature and pressure. The liquid refrigerant having a low temperature and pressure absorbs heat and is evaporated (through an evaporator) after entering into each of the first indoor heat exchanger 11 and the second indoor heat exchanger 13, and then turns into the gaseous refrigerant having a low temperature and pressure (the indoor air is cooled after passing through the surfaces of the heat exchangers, thereby dropping the indoor temperature). Afterwards, the gaseous refrigerant having a low temperature and pressure in the first indoor heat exchanger 11 enters into the first liquid accumulator 22 through the first port E and the second port S of the first four-way valve 28, and the gaseous refrigerant having a low temperature and pressure in the second indoor heat exchanger 13 enters into the second liquid accumulator 23 through the first port E and the second port S of the second four-way valve 29. Finally, the gaseous refrigerant having a low temperature and pressure is taken in by the compressor 21 again, and the foregoing process is repeated.

When the fresh-air air conditioning system is in a heating mode, the gaseous refrigerant having a low temperature and pressure is transformed into the gaseous refrigerant having a high temperature and pressure after being sucked and pressurized by the compressor, and enters into the fourth port D of the first four-way valve 28 and the fourth port D of the second four-way valve 29 via the exhaust end W of the compressor 21. The gaseous refrigerant having a high temperature and pressure is condensed and releases heat after entering into the first indoor heat exchanger 11 via the first port E of the first four-way valve 28 and the fourth port D of the second four-way valve 29, and then turns into the liquid refrigerant having a medium temperature and a high pressure (the indoor air is heated after passing through the surface of the heat exchanger, thereby increasing the indoor temperature). The liquid refrigerant having a medium temperature and a high pressure is throttled and depressurized by passing through the first throttle mechanism 12 and the second throttle mechanism 14, and turns into the liquid refrigerant having a low temperature and pressure. The liquid refrigerant having a low temperature and pressure absorbs heat and is evaporated after entering into the outdoor heat exchanger 27, and then turns into the gaseous refrigerant having low temperature and pressure (the outdoor air is cooled after passing through the surface of the heat exchanger, thereby dropping the temperature). Afterwards, the gaseous refrigerant having a low temperature and pressure in the first indoor heat exchanger 11 enters into the first liquid accumulator 22 through the third port C and the second port S of the first four-way valve 28, and the gaseous refrigerant having a low temperature and pressure in the second indoor heat exchanger 13 enters into the second liquid accumulator 23 through the third port C and the second port S of the second four-way valve 29. Finally, the gaseous refrigerant having a low temperature and pressure is taken in by the compressor 21 again, and the foregoing process is repeated.

When the first indoor heat exchanger 11 is turned on and the second indoor heat exchanger 13 is turned off (that is, the fresh-air air conditioning system is under partial load), the second electromagnetic valve 25 is closed and the first electromagnetic valve 24 and the third electromagnetic valve 26 are opened.

In this case, the outdoor unit 2 includes the outdoor heat exchanger 27, the first four-way valve 28, the first liquid accumulator 22, and the second liquid accumulator 23, the indoor unit 1 including the first throttle mechanism 12.

When the fresh-air air conditioning system is in a refrigeration mode, the gaseous refrigerant having a low temperature and pressure is transformed into the gaseous refrigerant having a high temperature and pressure after being sucked and pressurized by the compressor 21, and enters into the fourth port D of the first four-way valve 28 via the exhaust end W of the compressor 21 before entering into the outdoor heat exchanger via the third port C of the first four-way valve 28. The gaseous refrigerant having a high temperature and pressure releases heat (through condensation of a condenser) in the outdoor heat exchanger 27, and turns into the liquid refrigerant having a medium temperature and a high pressure (the heat is taken away by outdoor circulating air). The liquid refrigerant having a medium temperature and a high pressure is throttled and depressurized by the first throttle mechanism 12, and then turns into the liquid refrigerant having a low temperature and pressure. The liquid refrigerant having a low temperature and pressure absorbs heat and is evaporated (through an evaporator) after entering into the first indoor heat exchanger 11, and then turn into the gaseous refrigerant having a low temperature and pressure (the indoor air is cooled after passing through the surface of the heat exchanger, thereby dropping the indoor temperature). Afterwards, the gaseous refrigerant having a low temperature and pressure enters into the first liquid accumulator 22 and the second liquid accumulator 23 through the first port E and the second port S of the first four-way valve 28. The gaseous refrigerant having a low temperature and pressure is taken in by the compressor 21 again and the foregoing process is repeated.

When the fresh-air air conditioning system is in a heating mode, the gaseous refrigerant having a low temperature and pressure is transformed into the gaseous refrigerant having a high temperature and pressure after being sucked and pressurized by the compressor 21, and enters into the fourth port D of the first four-way valve 28 via the exhaust end of the compressor. The gaseous refrigerant having a high temperature and pressure is condensed and releases heat after entering into the first indoor heat exchanger 11 via the first port E of the first four-way valve 28, and then turns into the liquid refrigerant having a medium temperature and a high pressure (the indoor air is heated after passing through the surface of the heat exchanger, thereby increasing the indoor temperature). The liquid refrigerant having a medium temperature and a high pressure is throttled and depressurized by the first throttle mechanism 12, and turns into the liquid refrigerant having a low temperature and pressure. The liquid refrigerant having a low temperature and pressure absorbs heat and is evaporated after entering into the outdoor heat exchanger 27, and turns into the gaseous refrigerant having low temperature and pressure (the outdoor air is cooled after passing through the surface of the heat exchanger). Afterwards, the gaseous refrigerant having a low temperature and pressure enters into the first liquid accumulator 22 and the second liquid accumulator 23 through the third port C and the second port S of the first four-way valve 28. The gaseous refrigerant having a low temperature and pressure is finally taken in by the compressor 21 again and the foregoing process is repeated.

If the first indoor heat exchanger 11 is turned off and the second indoor heat exchanger 13 is turned on, then the first electromagnetic valve 24 is closed and the second electromagnetic valve 25 and the third electromagnetic valve 26 are opened.

In this case, the outdoor unit 2 includes the outdoor heat exchanger 27, the second four-way valve 29, the first liquid accumulator 22, and the second liquid accumulator 23, and the indoor unit 1 includes the second throttle mechanism 14.

When the fresh-air air conditioning system is in a refrigeration mode, the gaseous refrigerant having a low temperature and pressure is transformed into the gaseous refrigerant having a high temperature and pressure after being sucked and pressurized by the compressor 21, and enters into the fourth port D of the second four-way valve 29 via the exhaust end W of the compressor 21 before entering into the outdoor heat exchanger via the third port C of the second four-way valve 29. The gaseous refrigerant having a high temperature and pressure releases heat (through condensation of a condenser) in the outdoor heat exchanger 27, and turns into the liquid refrigerant having a medium temperature and a high pressure (the heat is taken away by outdoor circulating air). The liquid refrigerant having a medium temperature and a high pressure is throttled and depressurized by the second throttle mechanism 14, and turns into the liquid refrigerant having a low temperature and pressure. The liquid refrigerant having a low temperature and pressure absorbs heat and is evaporated (through an evaporator) after entering into the second indoor heat exchanger 13, and then turns into the gaseous refrigerant having a low temperature and pressure (the indoor air is cooled after passing through the surface of the heat exchanger, thereby dropping the indoor temperature). Afterwards, the gaseous refrigerant having a low temperature and pressure enters into the first liquid accumulator 22 and the second liquid accumulator 23 through the first port E and the second port S of the second four-way valve 29. The gaseous refrigerant having a low temperature and pressure is taken in by the compressor 21 again and the foregoing process is repeated.

When the fresh-air air conditioning system is in a heating mode, the gaseous refrigerant having a low temperature and pressure is transformed into the gaseous refrigerant having a high temperature and pressure after being sucked and pressurized by the compressor 21, and enters into the fourth port D of the second four-way valve 29 via the exhaust end of the compressor.

The gaseous refrigerant having a high temperature and pressure is condensed and releases heat after entering into the second indoor heat exchanger 13 via the first port E of the second four-way valve 29, and then turns into the liquid refrigerant having a medium temperature and a high pressure (the indoor air is heated after passing through the surface of the heat exchanger, thereby increasing the indoor temperature). The liquid refrigerant having a medium temperature and a high pressure is throttled and depressurized by the second throttle mechanism 14, and turns into the liquid refrigerant having a low temperature and pressure. The liquid refrigerant having a low temperature and pressure absorbs heat and is evaporated after entering into the outdoor heat exchanger 27, and then turns into the gaseous refrigerant having low temperature and pressure (the outdoor air is cooled after passing through the surface of the heat exchanger). Afterwards, the gaseous refrigerant having low temperature and pressure enters into the first liquid accumulator 22 and the second liquid accumulator 23 through the third port C and the second port S of the second four-way valve 29. The gaseous refrigerant having a low temperature and pressure is finally taken in by the compressor 21 again and the foregoing process is repeated.

The first throttle mechanism 12 throttles and reduces the pressure of the refrigerant passing through the first indoor heat exchanger 11, and the second throttle mechanism 14 throttles and reduces the pressure of the refrigerant passing through the second indoor heat exchanger 13.

Preferably, the first throttle mechanism 12 is an electronic expansion valve and the second throttle mechanism 14 is an electronic expansion valve. In other embodiments, the first throttle mechanism 12 and the second throttle mechanism 14 may also be other component or combination of components with a throttling function, such as capillary tube.

The first four-way valve 28 and the second four-way valve 29 are used to change the flow direction of the refrigerant, such that the evaporator running in a cooling condition turns into a condenser (i.e. the indoor heat exchanger functions as an evaporator in refrigeration mode, and functions as a condenser in heating mode). The refrigerant releases heat in the condenser, and the heat is blown into indoors by a blower, to supply heat.

To sum up, in the fresh-air air conditioning system and the control method thereof provided in the present invention, the fresh-air air conditioning system includes an indoor unit and an outdoor unit. The indoor unit includes a first indoor heat exchanger and a second indoor heat exchanger. The outdoor unit includes a compressor and an intake bypass circuit. When the fresh-air air conditioning system runs in partial load, i.e. the first indoor heat exchanger or the second indoor heat exchanger is turned off, the throttle mechanism corresponding to the closed indoor heat exchanger is closed. The switching solution of the intake bypass circuit at the intake side of the compressor enables two cylinders of the compressor to run simultaneously, thereby avoiding the situation of poor oil return caused by the long term single cylinder operation of the compressor, ensuring the reliability of the compressor, improving the system performance and the indoor comfort, and bringing in a better user experience.

The above merely describes preferred embodiments of the present invention, but does not impose any limitation to the present invention. Without departing from the scope of technical solution of the present invention, any equivalent changes or modifications of the technical solutions and technical contents disclosed in the present invention made by persons skilled in the art belong to the technical content of the present invention and fall within the protection scope of the present invention.

What is claimed is:

1. A fresh-air air conditioning system, comprising an indoor unit and an outdoor unit, wherein the indoor unit comprises a first indoor heat exchanger and a second indoor heat exchanger; and the outdoor unit comprises a compressor, an intake bypass circuit, a first liquid accumulator, and a second liquid accumulator; wherein the intake bypass circuit comprises a first electromagnetic valve, a second electromagnetic valve, and a third electromagnetic valve, a first end of the first electromagnetic valve being connected to a first end of the first indoor heat exchanger, a second end of the first electromagnetic valve being connected to a first intake end of the compressor and a first end of the third electromagnetic valve via the first liquid accumulator, a second end of the third electromagnetic valve being connected to a second intake end of the compressor and a first end of the second electromagnetic valve via the second liquid accumulator, a second end of the second electromagnetic valve being connected to a first end of the second indoor heat exchanger; and wherein when the first indoor heat exchanger or the second indoor heat exchanger is turned off, the third electromagnetic valve is opened so that the first liquid accumulator and the second liquid accumulator are simultaneously communicated with a turned-on one of the first indoor heat exchanger and the second indoor heat exchanger.

2. The fresh-air air conditioning system of claim 1, characterized in that wherein the outdoor unit further comprises an outdoor heat exchanger, a first four-way valve, and a second four-way valve, the first end of the first indoor heat exchanger being connected to a first port E of the first four-way valve, a second port S of the first four-way valve being connected to the first end of the first electromagnetic valve, a second end of the first indoor heat exchanger being connected to a first end of the outdoor heat exchanger, a second end of the outdoor heat exchanger being connected to a third port C of the first four-way valve and a third poll C of the second four-way valve, a fourth port D of the first four-way valve being connected to an exhaust end of the compressor, the first end of the second indoor heat exchanger being connected to a first port E of the second four-way valve, a second port S of the second four-way valve being connected to the second end of the second electromagnetic valve, a second end of the second indoor heat exchanger being connected to the first end of the outdoor heat exchanger, a fourth port D of the second four-way valve being connected to the exhaust end of the compressor.

3. The fresh-air air conditioning system of claim 1, wherein the indoor unit further comprises a first throttle mechanism and a second throttle mechanism, wherein the first throttle mechanism throttles and reduces a pressure of a refrigerant passing through the first indoor heat exchanger, and the second throttle mechanism throttles and reduces a pressure of a refrigerant passing through the second indoor heat exchanger.

4. The fresh-air air conditioning system of claim 3, wherein the first throttle mechanism is an electronic expansion valve and the second throttle mechanism is an electronic expansion valve.

5. A control method of a fresh-air air conditioning system, wherein the fresh-air air conditioning system comprises an indoor unit and an outdoor unit, the indoor unit comprises a first indoor heat exchanger and a second indoor heat exchanger, the outdoor unit comprises a compressor, an intake bypass circuit, a first liquid accumulator, and a second liquid accumulator, the intake bypass circuit comprises a first electromagnetic valve, a second electromagnetic valve, and a third electromagnetic valve, a first end of the first electromagnetic valve being connected to a first end of the first indoor heat exchanger, a second end of the first electromagnetic valve being connected to a first intake end of the compressor and a first end of the third electromagnetic valve via the first liquid accumulator, a second end of the third electromagnetic valve being connected to a second intake end of the compressor and a first end of the second electromagnetic valve via the second liquid accumulator, a second end of the second electromagnetic valve being connected to a first end of the second indoor heat exchanger, the method comprising:

opening a third electromagnetic valve when one of the first indoor heat exchanger and the second indoor heat exchanger is turned off, so that a first liquid accumulator and a second liquid accumulator are simultaneously communicated with a turned-on one of the first indoor heat exchanger and the second indoor heat exchanger.

6. The control method of claim 5, further comprising: closing a second electromagnetic valve and opening a first electromagnetic valve when the first indoor heat exchanger is set to be turned on and the second indoor heat exchanger is set to be turned off.

7. The control method of claim 6, wherein an outdoor unit comprises an outdoor heat exchanger and a first four-way valve; when the fresh-air air conditioning system is in a refrigeration mode, a refrigerant driven by a compressor enters into a fourth port D of the first four-way valve via an exhaust end of the compressor and enters into the outdoor heat exchanger via a third port C of the first four-way valve to release heat before entering into the first indoor heat exchanger for refrigeration, and then enters into the first liquid accumulator and the second liquid accumulator via a first port E and a second port S of the first four-way valve.

8. The control method of claim 6, wherein an outdoor unit comprises an outdoor heat exchanger and a first four-way valve; when the fresh-air air conditioning system is in a heating mode, a refrigerant driven by a compressor enters into a fourth port D of the first four-way valve via an exhaust end of the compressor and enters into the first indoor heat exchanger via a first port E of the first four-way valve to release heat before entering into the outdoor heat exchanger for heat absorption, and then enters into the first liquid accumulator and the second liquid accumulator via a third port C and a second port S of the first four-way valve.

9. The control method of claim 5, further comprising: closing a first electromagnetic valve and opening a second electromagnetic valve when the first indoor heat exchanger is set to be turned off and the second indoor heat exchanger is set to be turned on.

10. The control method of claim 9, wherein an outdoor unit comprises an outdoor heat exchanger and a second four-way valve; when the fresh-air air conditioning system is in a refrigeration mode, a refrigerant driven by a compressor enters into a fourth port D of the second four-way valve via an exhaust end of the compressor and enters into the outdoor heat exchanger via a third port C of the second four-way valve to release heat before entering into the second indoor heat exchanger for refrigeration, and then enters into the first liquid accumulator and the second liquid accumulator via a first port E and a second port S of the second four-way valve.

11. The control method of claim 9, wherein an outdoor unit comprises an outdoor heat exchanger and a second four-way valve; when the fresh-air air conditioning system is in a heating mode, a refrigerant driven by a compressor enters into a fourth port D of the second four-way valve via an exhaust end of the compressor and enters into the first indoor heat exchanger via a first port E of the second four-way valve to release heat before entering into the outdoor heat exchanger for heat absorption, and then enters into the first liquid accumulator and the second liquid accumulator via a third port C and a second port S of the second four-way valve.

12. The control method of claim 5, wherein the outdoor unit further comprises an outdoor heat exchanger, a first four-way valve, and a second four-way valve, the first end of the first indoor heat exchanger being connected to a first port E of the first four-way valve, a second port S of the first four-way valve being connected to the first end of the first electromagnetic valve, a second end of the first indoor heat exchanger being connected to a first end of the outdoor heat exchanger, a second end of the outdoor heat exchanger being connected to a third port C of the first four-way valve and a third port C of the second four-way valve, a fourth port D of the first four-way valve being connected to an exhaust end of the compressor, the first end of the second indoor heat exchanger being connected to a first port E of the second four-way valve, a second port S of the second four-way valve being connected to the second end of the second electromagnetic valve, a second end of the second indoor heat exchanger being connected to the first end of the outdoor heat exchanger, a fourth port D of the second four-way valve being connected to the exhaust end of the compressor.

13. The control method of claim 5, wherein the indoor unit further comprises a first throttle mechanism and a second throttle mechanism, wherein the first throttle mechanism throttles and reduces a pressure of a refrigerant passing through the first indoor heat exchanger, and the second throttle mechanism throttles and reduces a pressure of a refrigerant passing through the second indoor heat exchanger.

14. The control method of claim 13, wherein the first throttle mechanism is an electronic expansion valve and the second throttle mechanism is an electronic expansion valve.

* * * * *